United States Patent [19]

Kühnert

[11] Patent Number: 4,821,199

[45] Date of Patent: Apr. 11, 1989

[54] APPARATUS FOR ADJUSTING THE LENGTH AND THE MESH STRUCTURE OF KNITTED ARTICLES

[75] Inventor: Gottfried Kühnert, Aalen, Fed. Rep. of Germany

[73] Assignee: Universal Maschinenfabrik Dr. Rudolf Schieber GmbH & Co., Fed. Rep. of Germany

[21] Appl. No.: 29,292

[22] Filed: Mar. 23, 1987

[30] Foreign Application Priority Data

Mar. 21, 1986 [DE] Fed. Rep. of Germany ..... 3609719

[51] Int. Cl.[4] ..... G06F 15/46; D04B 15/48

[52] U.S. Cl. ..... 364/470; 66/125 R; 66/132 R; 66/146

[58] Field of Search ..... 364/470; 66/125 R, 132 R, 66/146, 210, 211, 213

[56] References Cited

U.S. PATENT DOCUMENTS

| | | | |
|---|---|---|---|
| 3,408,832 | 11/1968 | Renpei | 66/146 |
| 3,677,036 | 7/1972 | Hatay | 66/125 R X |
| 3,858,416 | 1/1975 | White et al. | 66/146 X |
| 4,194,375 | 3/1980 | Marchisio | 66/146 X |
| 4,199,965 | 4/1980 | Wilson | 66/125 R |
| 4,523,440 | 6/1985 | Voisin et al. | 66/146 |
| 4,662,407 | 5/1987 | Duncan | 66/210 X |
| 4,673,139 | 6/1987 | Memminger et al. | 66/125 R X |

*Primary Examiner*—Joseph Ruggiero

*Attorney, Agent, or Firm*—Sughrue, Mion, Zinn, Macpeak & Seas

[57] ABSTRACT

In a method and apparatus for adjusting the length and the mesh structure of a knitted article produced on a flat knitting machine, a yarn tension sensor is provided in the path of the yarn to be knitted for controlling the yarn tension, which sensor controls a yarn brake and/or a yarn restoring spring in the path before the yarn tension sensor via a process controller.

1 Claim, 1 Drawing Sheet

APPARATUS FOR ADJUSTING THE LENGTH AND THE MESH STRUCTURE OF KNITTED ARTICLES

The invention relates to a method and to apparatus for adjusting the length and the mesh structure of a knitted article produced on a flat knitting machine.

As a result of various technical conditions and parameters, such as yarn tension, fabric take-off and knitting speed, knitted articles produced on flat knitting machines are subject to length variation, which is in need of improvement.

Devices are known with which the length of the knitted article can be adjusted by means of control members In this connection, for example the knitted length of the knitted article is measured and by adjustment of the needle sinkers the take-off values for the knitted article to be produced next are corrected. This is an indirect measurement, and since the parameters for the next knitted article can be quite different, even for example at the point of delivery of the yarn, the corrected take-off values for this next knitted article may thus no longer lead to a correct length of the knitted article.

Furthermore, it is known to generate correction values during production of a knitted article, for example by sensing a repeat pattern, and then to supply these to a needle sinker setting device, for example in the form of stepping motors, for readjustment purposes.

From DE-OS No. 33 00 240 a device is known for length measurement in which the knitted article is measured during production and when a desired length is not reached after a pre-programmed number of knitted rows, a command is produced, for example to knit one more repeat On the other hand, if a predetermined length of the knitting is reached early, the program is interrupted and the machine is returned to the start position by means of a few additional carriage traverses, the yarn guide and off-set device being brought into the home position.

Finally, it is known to execute control in the yarn feed by means of length measurement of the yarn to be knitted. In this method, the length of the yarn to be knitted is monitored and is detected after a certain predetermined number of rows. The associated control members then supply any errors in the yarn length to setting devices for the needle sinkers, for example stepping motors, whereby the subsequent mesh rows are knitted with meshes of larger or smaller density.

In a flat knitting machine, yarns are supplied to the needles via yarn guides. The needles, which during knitting must fetch the yarns from a yarn spool, draw these from the yarn spool through several deflections. Since on the one hand the machine is nearly always operated with a plurality of yarns, and on the other hand also new yarn spools must be mounted for the yarn feed, differing yarn tension conditions are regularly produced Moreover, large yarn tension changes appear during carriage reversal. Those yarns which are fed in parallel from the outer left and right sides beneath the yarn feed rails to the yarn feed eyelets of the yarn guide, are subjected o fundamentally differing tensions after carriage reversal at the beginning of a new row of knitting. If the yarn is fed from the outer right to the yarn feed eyelets, upon carriage movement from the right towards the left at the beginning of the new row of knitting, larger tensions will result than if the carriage moves from left to right. When the carriage moves from right to left, the yarn must be immediately drawn from the yarn spool. When the carriage moves from left to right, only the yarn available from the right yarn deflector up to the left yarn guide eyelet release is knitted until more yarn is required from the yarn spool for the remainder of the row.

Although the needles are constantly withdrawn by a needle sinker, the needles which are just forming a mesh do not however draw the yarn only from the yarn spool, but also from the previously formed mesh whose needles are no longer held by the needle sinker.

The yarn which comes from the yarn spool passes through various control points, such as for example a knot catcher and a controller for discharge from the spool. Its tension is therefore strongly influenced by a yarn brake and a yarn restoring spring (tension spring). In known flat knitting machines, the yarn brake and the yarn restoring spring can be adjusted only by hand. If the yarn tension changes during production of a knitted article, for example as a result of variations in the winding of the yarn spools, this can only be adjusted by manual readjustment. The meshes become non-uniform, the quality of the mesh structure poor and also the knitted length varies.

A yarn equalisation device on a flat knitting machine is known from DE-OS No. 33 16 078 in which for forming a yarn loop a vertically movable yarn guide eye and an electromagnetically switchable yarn brake are provided in front of the yarn loop. As long as a yarn loop is formed by the yarn guide eye, the yarn brake is enabled and hinders further withdrawal of yarn from a yarn spool. If a sensor detects an upper end position of the yarn guide eye and thus a yarn loop of reduced length, the yarn brake is disabled or set to a predetermined degree of braking. No measurement of the yarn tension is performed.

The invention is based on the object of providing a method and apparatus of the type described which in a simple and secure manner enable length and mesh structure of a knitted article produced on a flat knitting machine to be continuously adjusted to a particularly high degree of constancy during knitting.

This object is achieved according to the invention with a method of the type described in which:

(a) the yarn tension of the yarn to be knitted is continuously measured before entry into the yarn guide eyelets;

(b) the measured value of the yarn tension is continuously compared with a predetermined desired tension value; and (c) the yarn tension is continuously adjusted to a predetermined desired tension value according to the desired/actual value comparison by means of braking and/or retraction of the yarn by means of a yarn brake and/or a yarn restoring spring.

Advantageously, the desired tension value is preset by a machine control device of the flat knitting machine.

When knitting with a plurality of yarns, the desired tension value of one yarn is expediently adjusted by the measured actual tension value of at least one further yarn.

The provision of the desired tension value and the desired/actual value comparison advantageously take place in a microprocessor.

Furthermore, the object on which the invention is based may be achieved with apparatus for adjusting the length and the mesh structure of knitted articles produced on a flat knitting machine which has a yarn brake and/or a yarn restoring spring between at least one yarn spool and a deflector for at least one yarn guide eyelet in the path of a yarn, wherein:

(a) in the path of the yarn after the yarn brake and/or the yarn restoring spring and before the yarn guide eyelets, a yarn tension sensor is arranged for measuring an actual yarn tension value in operative association with the yarn;

(b) the yarn brake and/or the yarn restoring spring is constructed to be automatically controllable;

(c) a process controller is provided for a predetermined desired value of the yarn tension; and (d) the process controller is coupled to the yarn tension sensor for sensing the actual yarn tension value and to the yarn brake and/or to the yarn restoring spring for setting the actual yarn tension value.

The process controller expediently comprises a microprocessor.

Furthermore, the process controller is advantageously integrated into a machine control device of an electronically controlled flat knitting machine.

According to a further development of the invention, the apparatus according to the invention is constructed in such manner that:

(e) a plurality of yarn guide eyelets and associated arrangements according to (a) and (b) are provided;

(f) the process controller is constructed for a corresponding plurality of desired values of the yarn tension, and (g) the process controller is coupled to each yarn tension sensor and each yarn brake and/or each yarn restoring spring.

Expediently, in this connection the desired values of the yarn tension are programmed into the process controller.

Furthermore, the desired values of the yarn tensions can be adjustable in the process controller in accordance with one or more actual yarn tension values.

By means of the monitoring according to the invention of the yarn withdrawal tension with the aid of a yarn tension sensor, the tension variations within a yarn and also the tension differences in a plurality of individual yarns to be knitted can be mutually adjusted. By the connection of the yarn tension sensor to the yarn brakes assigned to the yarns and the yarn restoring springs, all differing yarn tensions occurring can be equalised in a simple manner.

Both the yarn brakes and also the yarn restoring springs expediently have stepping motors for adjustment, which are controlled in turn directly by the process controller.

The invention is described in more detail in the following on the basis of an exemplary embodiment with reference to the drawings, in which.

Figure 1:
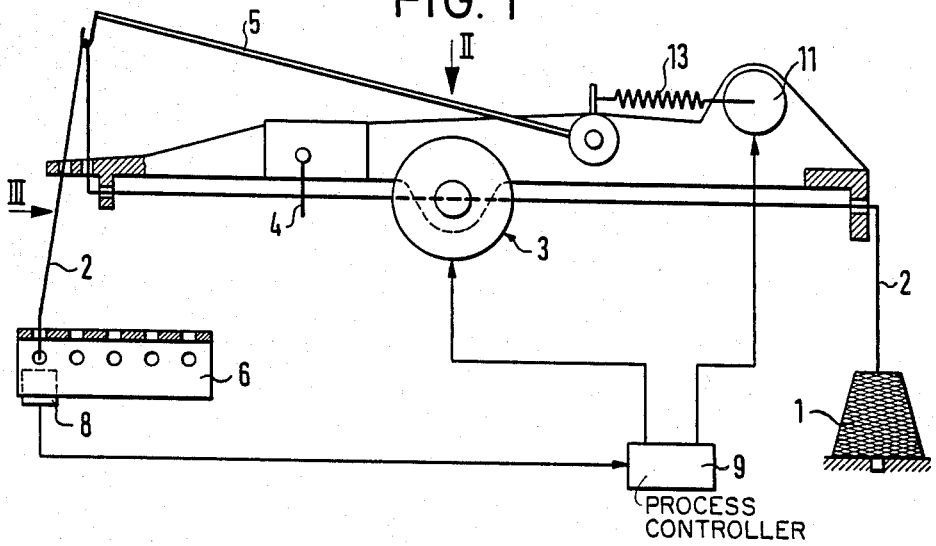
FIG. 1 shows a schematic representation of a side view of an exemplary embodiment of the device according to the invention.
Figure 2:
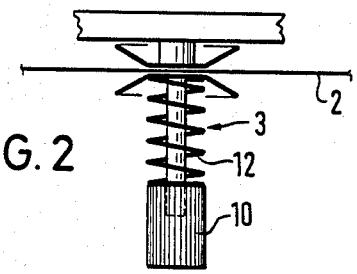
FIG. 2 shows a schematic representation of the yarn brake in the device according to FIG. 1, seen in the direction of the arrow II in FIG. 1.
Figure 3:
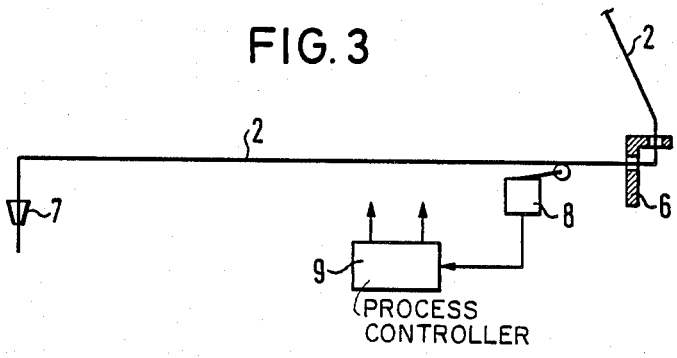
FIG. 3 shows a schematic representation of the device of FIG. 1, seen in the direction of the arrow III in FIG. 1.

The device illustrated in the drawing has a yarn spool 1 from which a yarn 2 to be knitted is drawn. The yarn coming from the yarn spool 1 passes through a yarn brake 3, a knot catcher 4 and a restoring spring 5. By means of a deflection plate 6, the yarn 2 is supplied to the yarn guide eyelets 7 of a yarn guide movable longitudinally of the flat knitting machine.

In the region of the yarn outlet from the deflection plate 6, is arranged a yarn tension sensor 8 in operative association with the yarn 2. The output signal of the yarn tension sensor 8, corresponding to the actual yarn tension value, is supplied to a process controller 9. The process controller 9, which advantageously comprises a microprocessor and can be integrated into the machine control device of an electronically controlled flat knitting machine, performs a comparison of the actual yarn tension value with a desired yarn tension value programmed therein.

Both the yarn brake 3 and also the yarn restoring spring 5 can be automatically controlled by the process controller 9. They each expediently comprise a respective stepping motor 10 or 11 via which the bias of a spring 12 or 13 is set.

If now the now the yarn tension changes in the course of manufacture of a knitted article, even during the course of a row, then this is detected by the yarn tension sensor 8, compared in the process controller 9 with a desired yarn tension value pre-programmed according to the stitch and the yarn, and the result of the desired value/actual value comparison is forwarded to the yarn brake 3 and/or the yarn restoring spring 5 or their stepping motors 10,11. The yarn tension is thus continuously controlled to the predetermined desired yarn tension value and this is achieved by changing the braking or restoring spring force of the yarn brake 3 or the yarn restoring spring 5.

One of the described devices is provided for each yarn guide having yarn guide eyelets 7 of a flat knitting machine. All these devices operate with a single process controller 9. In this connection, differing desired yarn tension values for the various yarns can be programmed into the process controller 9. The desired values of the yarn tensions can also be adjusted in the process controller 9 by one or more actual yarn tension values.

The invention leads in an extremely simple and reliable manner to equalisation of the length and the mesh structure of a knitted article produced on a flat knitting machine by simple sensing of the yarn tension before the knitting needles and control of this yarn tension to a predetermined value for equalisation of yarn tension changes caused by the type of yarn, the yarn guidance and the yarn movement.

What is claimed is:

1. An apparatus for adjusting the length and mesh structure of knitted articles produced on a flat bed knitting machine comprising yarn guide eyelet means, yarn supply means for supplying at least one yarn to said yarn guide eyelet means, spring biased yarn braking means and spring biased yarn retracting means adapted to engage said at least one yarn between said yarn supply means and said yarn guide eyelet means, each of said spring biased yarn braking means and said spring biased yarn retracting means having electrically controlled means connected thereto for controlling the respective spring force, yarn tension sensing means being disposed between said spring biased yarn retracting means and said yarn guide inlet means for measuring the actual yarn tension of said at least one yarn and providing an electrical signal indicative of said actual yarn tension, and microprocessor means having a value indicative of desired yarn tension stored therein connected to said electrical control means for each of said spring biased means and said yarn tension sensing means for controlling the spring force of at least one of said spring biased means in response to an electrical signal generated by said microprocessor in response to a comparison of actual yarn tension with desired yarn tension.

* * * * *